US008167782B2

(12) United States Patent
Hazantonis et al.

(10) Patent No.: US 8,167,782 B2
(45) Date of Patent: May 1, 2012

(54) METHOD AND APPARATUS FOR MAKING A PAINT ROLLER AND PRODUCT PRODUCED THEREBY

(75) Inventors: Anthony Hazantonis, Douglaston, NY (US); Joseph DeAngelis, Lynbrook, NY (US)

(73) Assignee: Linzer Products Corp., Wyandanch, NY (US)

( * ) Notice: Subject to any disclaimer, the term of this patent is extended or adjusted under 35 U.S.C. 154(b) by 670 days.

(21) Appl. No.: 11/756,108

(22) Filed: May 31, 2007

(65) Prior Publication Data

US 2008/0196821 A1 Aug. 21, 2008

Related U.S. Application Data

(60) Provisional application No. 60/890,232, filed on Feb. 16, 2007.

(51) Int. Cl.
*B05C 1/08* (2006.01)
*B44D 5/00* (2006.01)

(52) U.S. Cl. ..... 492/17; 15/230.12; 15/230.13; 15/230.11; 492/16

(58) Field of Classification Search ..... 492/13, 492/17, 16; 15/230.11, 230.12, 230.13
See application file for complete search history.

(56) References Cited

U.S. PATENT DOCUMENTS 2,247,197 A 6/1941 Graves
2,255,887 A 9/1941 Katz
2,331,969 A 10/1943 Friedrichs et al.
2,411,842 A 12/1946 Adams
2,422,842 A 6/1947 Molyneux et al.
2,647,300 A * 8/1953 Thomas et al. ..... 492/29
2,708,763 A * 5/1955 Jacoby ..... 401/194
2,743,469 A * 5/1956 Ditch ..... 401/197
2,776,698 A 1/1957 Kreger
2,789,075 A 4/1957 Stahl
2,806,803 A 9/1957 Thackara et al.

(Continued)

FOREIGN PATENT DOCUMENTS

BR 9702732 A * 3/1999

(Continued)

OTHER PUBLICATIONS

International Search Report for International Application No. PCT/US 09/31668, International Filing Date Jan. 22, 2009; Completion Date of Search Report, Feb. 23, 2009; Mailing Date of Search Report Mar. 19, 2009.

(Continued)

*Primary Examiner* — Essama Omgba
(74) *Attorney, Agent, or Firm* — RatnerPrestia

(57) ABSTRACT

A core for a paint roller includes a base layer and a reinforcing layer positioned over the base layer. A method of assembling a paint roller core includes helically winding a base material around a mandrel, applying an adhesive to an exposed portion of the base material, helically winding a reinforcing material around the base material, and applying the adhesive to an exposed portion of the reinforcing material. An apparatus for forming a paint roller includes a mandrel, a first feeder for continuously winding a base material around the longitudinal axis of the mandrel, a second feeder for continuously winding a reinforcing material around the base material, a third feeder for continuously winding a fabric cover around the reinforcing material, and a belt drive arranged around the mandrel for advancing the base material, reinforcing material and fabric cover along the mandrel.

20 Claims, 2 Drawing Sheets

U.S. PATENT DOCUMENTS

| | | | | | |
|---|---|---|---|---|---|
| 3,030,696 | A | | 4/1962 | Serwer | |
| 3,126,306 | A | | 3/1964 | Sherman | |
| 3,226,799 | A | | 1/1966 | Grodberg et al. | |
| 3,228,308 | A | | 1/1966 | Deneberg | |
| 3,317,367 | A | * | 5/1967 | Koller | 428/92 |
| 3,332,131 | A | * | 7/1967 | Weiler | 492/48 |
| 3,334,006 | A | * | 8/1967 | Koller | 428/88 |
| 3,401,073 | A | | 9/1968 | Wood | |
| 3,411,931 | A | | 11/1968 | Burns et al. | |
| 3,429,522 | A | | 2/1969 | Cunningham et al. | |
| 3,430,543 | A | | 3/1969 | Cunningham | |
| 3,457,130 | A | | 7/1969 | Morrison | |
| 3,460,445 | A | | 8/1969 | Reid | |
| 3,518,970 | A | | 7/1970 | Burns et al. | |
| 3,524,779 | A | | 8/1970 | Edmund et al. | |
| 3,555,976 | A | | 1/1971 | Carter et al. | |
| 3,563,826 | A | | 2/1971 | O'Neal, Jr. | |
| 3,607,492 | A | | 9/1971 | Keith et al. | |
| 3,620,869 | A | | 11/1971 | Stump | |
| 3,687,778 | A | | 8/1972 | Cichoski et al. | |
| 3,700,520 | A | | 10/1972 | Hielema | |
| 3,761,335 | A | | 9/1973 | Cichoski et al. | |
| 3,960,624 | A | | 6/1976 | Erland | |
| 4,010,054 | A | | 3/1977 | Bradt | |
| 4,078,957 | A | | 3/1978 | Bradt | |
| 4,165,956 | A | | 8/1979 | Hendy | |
| 4,191,792 | A | | 3/1980 | Janssen | |
| 4,434,521 | A | * | 3/1984 | Martin et al. | 15/230.11 |
| 4,689,003 | A | | 8/1987 | Schreiner et al. | |
| 4,692,975 | A | | 9/1987 | Garcia | |
| 5,137,595 | A | | 8/1992 | Garcia | |
| 5,146,646 | A | | 9/1992 | Langford et al. | |
| 5,195,242 | A | | 3/1993 | Sekar | |
| 5,206,968 | A | | 5/1993 | Bower et al. | |
| 5,273,604 | A | | 12/1993 | Garcia | |
| 5,294,276 | A | | 3/1994 | Linn et al. | |
| 5,397,414 | A | | 3/1995 | Garcia et al. | |
| 5,398,409 | A | | 3/1995 | Sekar | |
| 5,401,231 | A | * | 3/1995 | Hebert | 492/37 |
| 5,468,207 | A | | 11/1995 | Bower et al. | |
| 5,490,303 | A | * | 2/1996 | Graves | 15/230.11 |
| 5,537,745 | A | | 7/1996 | Musch et al. | |
| 5,572,790 | A | | 11/1996 | Sekar | |
| 5,694,688 | A | | 12/1997 | Musch et al. | |
| 5,862,591 | A | | 1/1999 | Kulkaski | |
| 6,145,195 | A | | 11/2000 | Wieres | |
| 6,145,196 | A | | 11/2000 | Ripstein | |
| 6,159,134 | A | | 12/2000 | Sekar | |
| 6,175,985 | B1 | | 1/2001 | Chambers et al. | |
| 6,199,279 | B1 | | 3/2001 | Humphrey et al. | |
| 6,231,711 | B1 | | 5/2001 | Roberts et al. | |
| 6,247,300 | B1 | | 6/2001 | Muramatsu et al. | |
| 6,254,710 | B1 | | 7/2001 | Sekar | |
| 6,539,999 | B2 | | 4/2003 | Polzin et al. | |
| 6,615,490 | B2 | * | 9/2003 | Polzin | 29/895.211 |
| 2001/0045014 | A1 | | 11/2001 | Polzin | |
| 2002/0066521 | A1 | | 6/2002 | Sekar | |
| 2002/0077234 | A1 | | 6/2002 | Sekar | |
| 2002/0112810 | A1 | | 8/2002 | Polzin et al. | |
| 2002/0139228 | A1 | | 10/2002 | Johnston et al. | |
| 2004/0159977 | A1 | * | 8/2004 | Perfetto et al. | 264/293 |
| 2009/0191390 | A1 | * | 7/2009 | Saji et al. | 428/213 |

FOREIGN PATENT DOCUMENTS

| | | |
|---|---|---|
| CA | 2 170 722 | 4/2002 |
| CA | 2 153 139 | 12/2003 |
| DE | 1928269 | 12/1970 |
| DE | 36 19 002 | 12/1987 |
| DE | 40 07 240 | 10/1990 |
| DE | 41 42 684 | 12/1991 |
| EP | 0 069 335 | 1/1983 |
| EP | 0 744 275 | 11/1996 |
| ES | 2 010 431 | 11/1989 |
| FR | 2093060 | 1/1972 |
| JP | 55019511 | 2/1980 |
| JP | 63027234 | 2/1988 |
| WO | WO 91/02604 | 3/1991 |
| WO | WO 98/18567 | 5/1998 |

OTHER PUBLICATIONS

International Preliminary Report on Patentability for International Application No. PCT/US2008/001132. Date of Mailing Aug. 27, 2009.

International Search Report dated May 20, 2008, application No. PCT/US/08/01132.

Chinese Office Action for Application No. 20088004932.6 dated Jul. 13, 2010 (with English Translation).

* cited by examiner

METHOD AND APPARATUS FOR MAKING A PAINT ROLLER AND PRODUCT PRODUCED THEREBY

FIELD OF THE INVENTION

The present invention relates generally to paint rollers and methods of manufacturing the same. More specifically, the present invention relates to an improved paint roller and roller core, and method of and apparatus for making such roller and roller core, in which a reinforcing material is utilized.

BACKGROUND

Paint rollers, also known as paint roller covers, are widely used by both amateurs and professionals to paint surfaces, such as walls and ceilings, quickly and economically, as well as with relative ease. Paint rollers are typically comprised of a tubular core and a paint absorbing cover or layer that is affixed to the core. The tubular core may be a solid structure, or the tubular core may be composed of a helically wound strip or strips of material that are bonded together. The paint absorbing cover may be made from a woven synthetic or natural fabric, or other materials that are well known in the art.

Methods of helically winding strips of materials around a mandrel to form a paint roller are well known. Such methods may allow paint rollers to be manufactured in a continuous, assembly line fashion. Early paint rollers made in this manner used paperboard strips to form the core. In such well known processes, multiple strips of paperboard are helically wound around a mandrel and are bonded together by an application of adhesive between the strips, which cures to form a core. A belt drive is placed on the formed core and is used to advance the core down the assembly line. A second application of adhesive is then applied to the formed core, after which a fabric cover is helically wound onto the formed core. A cutter is then used to cut the endless roller into sticks. The sticks are then cut to size and finished into usable paint rollers.

A disadvantage to paperboard core paint rollers is that paperboard is exceedingly soluble, especially in solvents. As a result, such cores would often times delaminate during use or cleaning.

In an attempt to solve the delaminating problem associated with ordinary paperboard cores, phenolic impregnated paperboard strips were used in lieu of ordinary paperboard. However, even phenolic cores tend to delaminate after prolonged exposure to solvents. In addition, manufacturing processes utilizing phenolic impregnated paperboard strips were slow and required a long assembly line. The use of phenolic impregnated paperboard strips also created environmental issues.

Another attempt to solve the delaminating problem is disclosed in U.S. Pat. No. 5,195,242 issued to Sekar ("the Sekar '242 patent"). In the process described in the Sekar '242 patent, Sekar disclosed helically winding multiple strips of thermoplastic material instead of paperboard or phenolic strips. It is well known that thermoplastic materials are resistant to paint solvents. In particular, multiple strips of thermoplastic material may be helically wound around a stationary mandrel and bonded together using preheated, liquid, thermoplastic to form a core. As with the paperboard and phenolic process, a belt drive is placed on the formed core for advancing the core down the line. A second application of liquid thermoplastic material is then applied to the formed core as an adhesive. A fabric cover is helically wound onto the formed core. A cutter is then utilized to cut the endless roller into sticks. The sticks are then cut to size and finished into usable paint rollers.

The process described in the Sekar '242 patent has several drawbacks. Because the manufacturing process involves the use of multiple strips of thermoplastic material and multiple points of application of liquefied thermoplastic, the process would be difficult to set up and operate. Additionally, such a process is expensive because it requires multiple nozzles for each strip of thermoplastic material. It has also been reported that cores formed of only thermoplastic material tend to be weaker than cores formed of other material, such as metal and cardboard strips; thus the useful life of such paint rollers is relatively short.

U.S. Pat. No. 5,468,207 issued to Bower ("the Bower '207 patent") disclosed a continuous paint roller manufacturing process using multiple thermoplastic strips similar to the process described in the Sekar '242 patent, with the exception that Bower disclosed using direct heat, instead of liquefied thermoplastic, to bond the thermoplastic strips together to form a core. Bower also disclosed using direct heat, rather than liquefied thermoplastic, to bond the fabric cover to the formed core. The process disclosed in the Bower '207 patent suffers from the same disadvantages as the process disclosed in the Sekar '242 patent. In addition, the use of heaters to bond the multiple thermoplastic strips together and to bond the fabric cover to the formed core is believed to create additional difficulties in the determination of the amount of heat to be applied and the creation of even adhesive layers.

Another well known process that is in present commercial use resolved some of the complexity problems associated with multiple thermoplastic strip processes, such as the processes disclosed in the Bower and Sekar Patents. In this process, which appears to be described in Canadian Pat. No. 2,170,722 also issued to Sekar ("the Canadian '722 patent"), a single strip of thermoplastic material is helically wound about a mandrel, instead of forming a core by helically winding multiple strips. A single application of liquefied thermoplastic material is then applied to the wound strip. Thereafter, a fabric cover strip is helically wound directly over the liquefied thermoplastic and wound strip. A cutter is then utilized to cut the endless formed roller into individual sticks. The sticks are then cut to size and finished into usable paint rollers.

In contrast to certain well known multiple strip processes disclosed in the prior art, such as the Bower and Sekar processes discussed above, a belt drive in the single thermoplastic strip process could not be placed on the wound strip prior to the application of liquefied thermoplastic since there is no formed core prior to the application of the fabric cover. Instead, in the single thermoplastic strip process, the belt drive is placed on the fabric cover so the endless formed paint roller can be advanced down the assembly line.

However, the paint roller resulting from the single thermoplastic strip process described above is prone to certain defects. The ends of the wound strip of such rollers have a tendency to break apart, or unfurl, from the successive wind, which results in the end of the wound strip sticking out, consequently making the roller appear "out of round." This defect is due to the high tension memory of the thermoplastic strip. In addition, paint rollers made from a single strip of thermoplastic are more susceptible to being crushed and may not have the desirable hardened feel of multiple layer or solid core paint rollers. In an effort to achieve the hardened feel of a multiple layer or solid core paint roller, thicker thermoplastic strips may be used. However, using thicker strips increases the potential for unfurling of the wound strip due to the higher tension memory of the thicker strip.

In view of the complexity of the methods of manufacturing multiple layer paint rollers, such as the phenolic processes in Sekar '242 and Bower '207 discussed above, and further in view of the defects associated with the single strip process described in Sekar's Canadian '722 patent, methods attempting to address one or more of these problems have been disclosed in subsequent patents.

One such method is disclosed in U.S. Pat. No. 6,159,134, also issued to Sekar ("the Sekar '134 patent"). The Sekar '134 patent discloses a method of manufacturing paint rollers comprising the steps of: helically advancing a first strip of thermoplastic material about a mandrel; helically advancing a second strip of thermoplastic material about the first strip of thermoplastic material in offset relation therewith; helically advancing a cover about the second strip; providing an adhesive between the outer surface of the first strip and the inner surface of the second strip; providing an adhesive between the outer surface of the outer strip and the inner surface of the cover; and forming a continuous laminated paint roller by applying a compressive force upon the cover. One disadvantage with this method is that it requires a second strip of thermoplastic material and multiple applications of adhesive. These factors add to production cost and increase the size and complexity of the assembly line. The second strip of thermoplastic material may also increase packaging and bulk transportation costs due to the additional weight of the second strip.

It would therefore be desirable to provide a method for manufacturing a robust, lightweight paint roller utilizing a single strip of base material in the interest of maximizing its structural integrity, decreasing its cost, and decreasing its shipping weight.

SUMMARY OF THE INVENTION

The foregoing drawbacks of paint rollers and paint roller manufacturing processes are resolved to a large extent by a method and apparatus for manufacturing a paint roller, and by products that are produced from the method and apparatus, all of which are in accordance with the invention, as will be described herein in the form of exemplary embodiments.

In a first aspect of the invention, a core for a paint roller includes a base layer and a reinforcing layer including a mesh that is positioned over the base layer.

In a second aspect of the invention, a paint roller includes a base layer, a reinforcing layer including a mesh positioned over the base layer, and a fabric cover positioned over the reinforcing layer.

In a third aspect of the invention, a method of assembling a paint roller includes the steps of helically winding a base material around a mandrel, applying an adhesive to an exposed portion of the base material, helically winding a reinforcing material around the base material, applying adhesive to an exposed portion of the reinforcing material, and helically winding a fabric cover over the reinforcing material.

In a fourth aspect of the invention, a method of assembling a core for a paint roller includes the steps of helically winding a base material around a mandrel, applying an adhesive to an exposed portion of the base material, helically winding a reinforcing material around the base material, and applying the adhesive to an exposed portion of the reinforcing material.

In a fifth aspect of the invention, an apparatus for forming a paint roller includes a mandrel having a longitudinal axis, a first feeder for continuously winding a base material around the longitudinal axis of the mandrel, a second feeder for continuously winding a reinforcing material around the base material, a third feeder for continuously winding a fabric cover around the reinforcing material, and a belt drive including one or more belts arranged around the mandrel for advancing the base material, reinforcing material and fabric cover along the mandrel.

DETAILED DESCRIPTION

Figure 1:
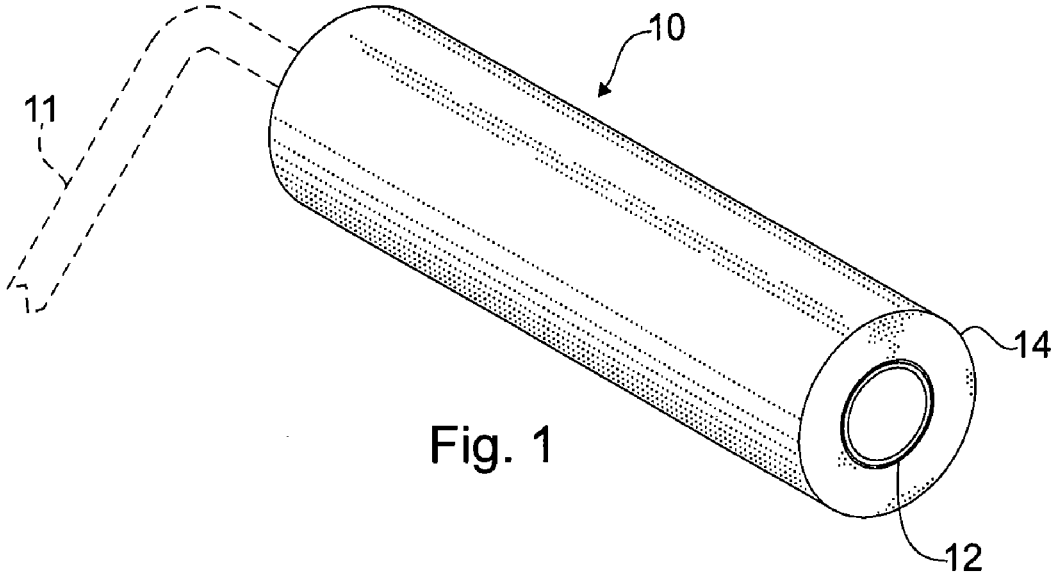
FIG. 1 is a perspective view of a paint roller made in accordance with one embodiment of the present invention.

In FIG. 1, a paint roller 10 in accordance with one embodiment of the present invention is shown. Paint roller 10 is of the type which is normally attached to a roller handle assembly 11, which is illustrated in phantom in FIG. 1. Paint roller 10 may be constructed to operate successfully with a variety of roller handle assemblies.

Paint roller 10 has a tubular core 12 comprised of a single inner layer, or ply, of helically wound base material. The helically wound base material is preferably a thermoplastic material, and more preferably polypropylene. Helically wound about the base material is a reinforcing material, which is attached to the base material, preferably by a suitable adhesive, such as liquid polypropylene. The reinforcing material may comprise a non-thermoplastic mesh material, such as a fiberglass mesh, for example. Attached to the outer surface of core 12, by the adhesive, is a paint applying fabric cover 14. The fabric cover 14 may be a conventional roller cover fabric that preferably has a heavy open weave backing made of a suitable thermoplastic material such as polyester woven into the fabric to allow for a superior mechanical bond between the fabric backing and base material. The fabric pile or nap may be composed of various materials or material blends, and be of different heights depending on the particular application.

Figure 2:
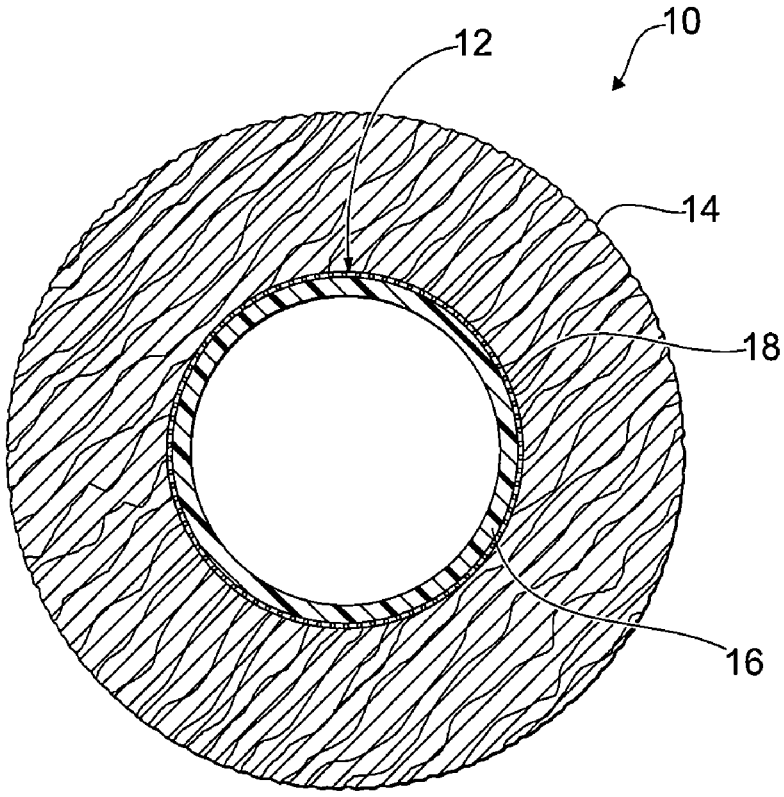
FIG. 2 is a cross-sectional view of the paint roller of FIG. 1.

FIG. 2 is a cross-sectional view of paint roller 10 showing a portion of core 12 and cover 14 in greater detail. As illustrated in FIG. 2, core 12 has a single inner layer, or ply, of base material 16 and an outer reinforcing material 18. The paint roller of the present invention has significant advantages over conventional paint rollers. Among other benefits, paint roller 10 exhibits may of the desirable properties of paint rollers made with multiple layers of thermoplastic strips (e.g., hardened feel, crush resistance, lower susceptibility to unfurling), while being less expensive to manufacture, lighter in weight, and less expensive to handle and ship.

Figure 3:
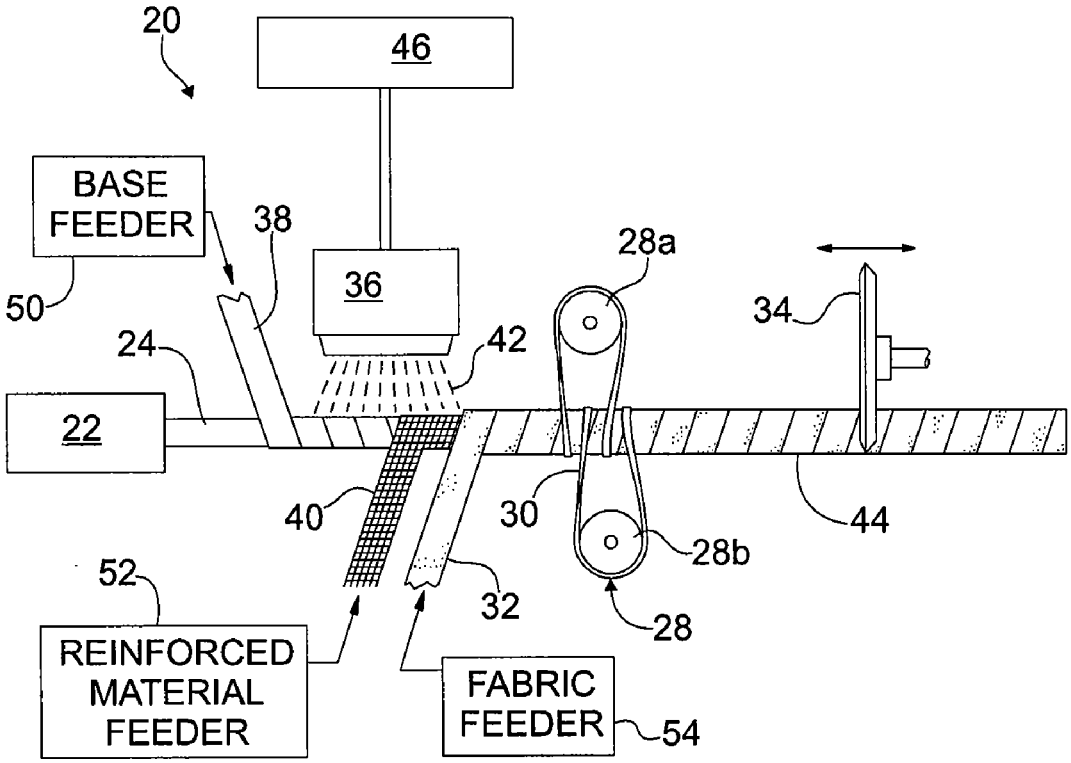
FIG. 3 is a diagrammatic representation of a side view of an apparatus for assembling paint roller cores and paint rollers in accordance with one embodiment of the present invention.

FIG. 3 illustrates the method and shows the apparatus by which a paint roller of the present invention may be fabricated. The paint roller manufacturing apparatus 20 includes a housing 22 to support a stationary mandrel 24 that is preferably tapered. The mandrel 24 may be cooled, preferably by an internal water chilling mechanism, to prevent the mandrel from overheating. As is well known, the diameter of the mandrel depends on the diameter of the paint roller desired. Generally, paint rollers are made with either 1.5-inch or 0.5-inch diameter cores. These diameter cores, as well as any other diameter core, can be made using this invention.

Paint roller manufacturing apparatus 20 includes a unique arrangement of feeder mechanisms and other components that produce an efficient and streamlined process. The relative position of the different components are particularly advantageous for reasons that will be better understood from the sections that follow. For purposes of description, the relative position of components may be described as being "downstream" or "upstream" from one another. "Downstream" generally refers to a direction toward the end of the assembly line, and "upstream" generally refers to the direction toward the beginning of the assembly line.

The paint roller manufacturing apparatus 20 further includes a driving apparatus, preferably a belt drive, which advances the endless paint roller along the mandrel. In FIG. 3, apparatus 20 includes a belt drive 28 having two powered drums 28*a* and 28*b* that are coupled to at least one drive belt 30. The drive belt 30 is preferably placed at a location immediately downstream of the location where a paint-applying fabric cover 32 is wound onto the mandrel. In this arrangement, the belt drive 28 is provided with sufficient traction to advance the base material, reinforcement material, and cover along the mandrel. In addition, the downstream position of the belt drive 28 permits the belt drive to simultaneously serve as the drive mechanism, and as a final compression mechanism to securely press all the roller layers together.

A cutting device 34, which may be a "fly-away" cutter, cuts the endless paint roller into useable segments, or "sticks". The sticks are then again cut to the desired length and finished into usable paint rollers.

The paint roller manufacturing apparatus 20 also includes one or more feeders for adding each of the component parts to the paint roller. The feeder mechanisms may be in the form of spindles, spools or other application means that allow for the materials, which typically are supplied in rolls, to be applied in a continuous fashion. In FIG. 3, a first feeder 50 continuously feeds base material 38, and a second feeder 52 continuously feeds reinforcing material 40. A third feeder 54 continuously feeds fabric cover 32. As an alternative to continuous feeders, any of the materials may be applied by hand.

The paint roller manufacturing apparatus 20 further includes an adhesive application means. The adhesive application means may be in the form of a single head 36, although multiple heads could be used. According to one exemplary embodiment, the head 36 distributes adhesive material, such as polypropylene. Head 36 is coupled to an adhesive extrusion device which includes a heater tube that receives a supply of polypropylene pellets that are melted within the heater tube and advanced with the tube by a screw-type mechanism to the head 36. Head 36 may be a die, where the source of the adhesive material is an extruder. Preferably, head 36 is placed in close proximity to the fabric cover 32.

In accordance with one process of the invention, the first step in making continuous paint rollers using apparatus 20 is to helically wind a strip of base material 38 about a longitudinal axis of a mandrel. The helically wound base material may be a thermoplastic material such as polypropylene. Polypropylene strips are commercially available and may be provided in the form of a roll. As is well known in the art, a lubricant such as 5% mineral oil may be applied to the inner surface of the thermoplastic strip prior to winding the strip onto the mandrel, in order to reduce friction between the wound strip and the mandrel as the wound strip advances along the mandrel.

A strip or layer of reinforcing material is helically wound about the wound strip of base material 38. A variety of materials may be used for the reinforcing layer. Preferably, the reinforcing layer is made from a thin light-weight non-thermoplastic material with a high tensile strength. In FIG. 3, the reinforcing layer is a fiberglass mesh 40. Fiberglass reinforcing mesh 40 is preferably applied as a strip having the same width as the base material 38. In addition, mesh 40 is preferably provided in roll form, and has an open weave with relative large openings. Fiberglass reinforcing mesh 40 may be formed from any commercially available material, such as mesh material manufactured by New York Wire Company, 152 North Main Street, Mount Wolf, Pa., USA. Reinforcing mesh 40 may also be formed from other synthetic or natural materials, including but not limited to nylon, polyethylene, rayon, polyacylonitrile, cellulose, hemp or sisal. The reinforcing mesh may also be formed from fine metal wire, such as screen material.

During assembly, an adhesive material 42, such as liquid polypropylene, is applied from head 36. Adhesive material 42 may be applied in a layer, such as a single layer that is applied in such a manner so it will cover both the exposed portion of the strip of base material 38 and the exposed portion of reinforcing mesh 40. More specifically, head 36 may be positioned along mandrel 24 at a location downstream relative to the location where base material 38 is wound onto the mandrel, and aligned more or less with the location where reinforcement layer 40 is wound onto the mandrel. In this arrangement, a single application of adhesive will bond the adjacent turns of base material 38 with one another, and simultaneously bond the reinforcement layer 40 to the bonded turns of base material, all from a single stream or application of adhesive. The reinforcing material 40 will be effectively embedded in the adhesive material 42, substantially eliminating any ridges or bumps in the finished product. A fabric cover 32 is helically wound about the adhesively embedded reinforcing material 40 and bonded to the wound strip of base material 38 and reinforcing material 40. Using this assembly process, a reinforced, single-ply paint roller can be manufactured with only four feeder mechanisms applying material onto the mandrel.

The orientation of base material 38, reinforcing material 40 and fabric cover 32 may vary from the orientations shown and described herein. Upon winding the reinforcing material 40 onto the base material 38, for example, the edges of the strip of reinforcing material 40 may be offset from the edges of the strip of base material 38. The reinforcing material 40 may be offset from the base material in multiple ways. For example, reinforcing material 40 may be wound onto the mandrel in an angularly offset or transverse orientation relative to the base material 38, forming a criss-cross overlap. This criss-cross arrangement is illustrated in FIG. 3, between base material 38 and reinforcing material 40. Alternatively, reinforcing material 40 may be wound onto the mandrel in a longitudinally offset position, but parallel orientation, relative to the turns of the base material 38, so that the center of the reinforcing mesh overlaps the joints of the wound strip of base material. This type of offset arrangement is illustrated in FIG. 3, between reinforcing material 40 and cover material 32.

Prior to the hardening and setting of the layer of adhesive material 42, the drive belt 30 may be used to apply pressure to the outer surface of the fabric cover 32 and the component parts below, strengthening the bonds between the layers of material. In such an arrangement, belt drive 28 serves dual purposes of advancing the roller through the assembly line and pressing the layers together to form a tightly bound construction. A continuous paint roller 44 is formed about the mandrel.

In an additional embodiment of the present invention, the reinforcing material 40 may be a solid strip of paperboard or metal reinforcing material to produce a sufficiently strong and lightweight core. As with the embodiments described above, the fabric cover 32 could be wound in an orientation that is parallel to either to the reinforcing material 40 or thermoplastic strip 38. The following are intended to be further non-limiting examples and illustrations of the invention.

1. A paint roller comprising;

a. an inner layer or ply of base material;

b. a reinforcing material; and c. a fabric cover.

The layer or ply of base material of this embodiment may be formed from any suitable material, such as a thermoplastic material (e.g., polypropylene). The reinforcing material of this embodiment may be formed from any suitable material, such as a fiberglass mesh. The fabric cover may formed from of any suitable material, and is preferably a fabric suitable for painting (or achieving some desired effect with paint), such as pile or nap with an open weave backing. The layer or ply of base material, reinforcing material and fabric cover are preferably bound together with an adhesive, and more preferably liquid polypropylene. Alternatively, the base material, reinforcement material and fabric cover may be heat bonded by applying heat to the thermoplastic base material. As noted above, heat bonding is less preferred because of the difficulties in setting optimum temperatures and avoiding uneven surfaces.

2. A method of making a paint roller comprising:

a. helically winding a layer or ply of base material around a mandrel;

b. applying an adhesive to the exposed portion of the base material;

c. helically winding a reinforcing material around the base material and adhesive on the mandrel;

d. applying an adhesive to the exposed portion of the reinforcing material;

e. helically winding a fabric cover over the base material, adhesive and reinforcing material on the mandrel; and f. applying a compressive force upon the outer surface of the fabric cover thereby forming a continuous paint roller.

The layer or ply of base material of this embodiment may be made of any suitable material, such as a thermoplastic material (e.g., polypropylene). The reinforcing material of this embodiment may be made of any suitable material, such as fiberglass mesh. The fabric cover may be made of any suitable material, and is preferably a fabric suitable for painting (or achieving some desired effect with paint), such as pile or nap with an open weave backing. The layer or ply of base material, reinforcing material and fabric cover may be bound together with an adhesive, such as liquid polypropylene. The adhesive may be applied in a single layer that is applied in such a manner from a single die head so that the layer of adhesive covers both the exposed portion of the base material and the exposed portion of the reinforcing mesh. Prior to the hardening and setting of the adhesive, the drive belt is used to apply a compressive force to the outer surface of the fabric cover and the component parts below, thereby forming a continuous paint roller about the mandrel.

3. An apparatus for making paint rollers comprising:

a. a mandrel;

b. a driving apparatus that advances paint roller components along the mandrel;

c. a base material application means;

d. a reinforcing material application means;

e. a fabric cover application means;

f. an adhesive application means that applies adhesive to the exposed portion of the base material and the exposed reinforcing material to bind the base material, reinforcing material and fabric cover together;

g. a compressing means that applies pressure upon the outer surface of the fabric cover thereby forming a continuous paint roller; and h. a cutting means to cut the formed endless paint roller into usable lengths.

The layer or ply of base material of this embodiment may be made of any suitable material, such as a thermoplastic material (e.g., polypropylene). The reinforcing material of this embodiment may be formed from any suitable material, such as fiberglass mesh. The fabric cover may be made of any suitable material, and is preferably a fabric suitable for painting (or achieving some desired effect with paint), such as pile or nap with an open weave backing. The layer or ply of base material, reinforcing material and fabric cover may be bound together to form a paint roller with an adhesive, such as liquid polypropylene. Prior to the hardening and setting of the adhesive, the drive belt is used to apply a compressive force to the outer surface of the fabric cover and the component parts below, thereby forming a continuous paint roller about the mandrel. Because the drive belt is positioned over the fabric cover, the drive belt is accordingly positioned downstream of the fabric cover supply with respect to the longitudinal axis of the mandrel.

The reinforcing layer has been described in terms of a mesh material. The term "mesh" may include a variety of materials including but not limited to porous or nonporous, and woven or non-woven fabrics, screens, sheaths, tapes, wires, grids, solid or perforated sheets, nets, lattice structures, powders and other materials, with or without laminates or coatings. Suitable reinforcing materials may include synthetic, metallic or other natural reinforcing materials. The reinforcing material may be resistant to solvents, or have other chemical properties that are desired for a specific painting application. Although the term "paint roller" has been used in this specification, the products and processes within the scope of the invention are not limited to paint applications per se, but may be used for any application in which a liquid is applied to a surface by a roller.

The single ply paint rollers of the present invention may be made to have the strength of multiple ply paint rollers, but are more cost efficient to manufacture and ship. The resulting paint rollers of the present invention do not exhibit the defects associated with non-reinforced single strip paint rollers, such as bending and buckling. Bending and buckling are substantially eliminated by the reinforcement layer, which provides an outer skeleton over the base material. This outer skeleton provides the structural integrity and hoop strength needed to withstand internal stresses exerted by the base material, and external forces, while adding virtually no size or weight to the core structure.

The reinforcing layer need not be a thick layer of material, and preferably has a nominal thickness of only a fraction the thickness of the base material. For example, a fiberglass mesh having a nominal thickness of less than 0.5 mm (0.197 in.) is desirable to provide a reinforcing layer that adds virtually no size or weight to the finished core. In a preferred embodiment, the mesh is made up mostly of relatively large openings separated from one another by relatively narrow wires, strands or the like. In this arrangement, the mesh is relatively light and allows for direct contact between substantially all of the base material and cover. This arrangement also creates substantial voids between the base material and cover, allowing adhesive to distribute uniformly around the wires or strands. The wires or strands that surround the openings have a tensile strength sufficiently high to overcome expansion forces and stresses exerted by the underlying core layer, such as the expansion forces created when a helically wound thermoplastic strip attempts to unwind. In addition, the mesh preferably has sufficient rigidity to hold its cylindrical shape around the base material and resist bending or buckling when the core is subject to external compressive forces. Because different base materials and base material thicknesses will be associated with different expansion forces, the required tensile strength for a given reinforcing layer will depend on the base material and its dimensions.

Figure 4:
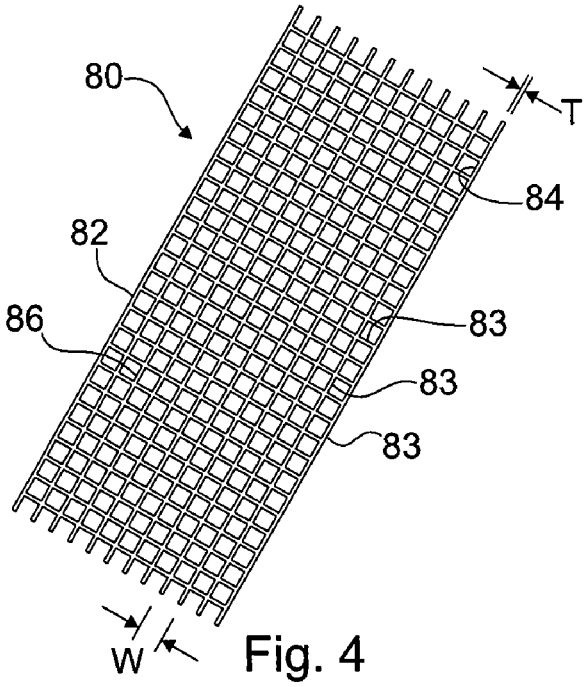
FIG. 4 is a truncated perspective view of a core reinforcing layer material in accordance with the present invention.

It may be desirable to use a mesh material that is manufactured with an adhesive backing on one side, such as a mesh tape. Referring to FIG. 4, a reinforcing fiberglass mesh tape 80 is shown in accordance with the present invention. Mesh tape 80 includes a grid 82 of fiberglass material defining square openings 84. Grid 82 has a plurality of strands 83 each having a nominal thickness "T". The width "W" of the square openings 84 are much larger than the nominal width of each strand, resulting in large voids in the mesh tape. An adhesive backing 86 is applied on one face or side of the tape. Mesh tape 80 may be fed from a roll and helically wound over the exterior exposed surface of base material to secure the turns of the base material together. The adhesive backing of the mesh tape provides additional bond strength at the joints between successive turns of base material, in addition to reinforcement provided by the tension of the mesh tape and liquid adhesive applied over the reinforcing layer. If an adhesive-backed reinforcing material is used, the adhesive is preferably compatible with the base material, and is resistant to chemical solvents that may be present in the liquid being applied by the roller. An adhesive-backed reinforcing material may be desirable in processes where the die head does not apply liquid polypropylene over the entire exterior of the wound base material. In the preferred process, the die head applies the adhesive over a majority of the exposed surface, but less than a majority may also be sufficient to securely bond the reinforcing layer over the base material.

Although the invention has been shown and described with respect to certain preferred embodiments, it is obvious that equivalent alterations and modifications will occur to others of ordinary skill in the art upon the reading and understanding of the specification. The present invention includes all such equivalent alterations and modifications.

What is claimed:

1. A reinforced core for a paint roller comprising:

a base layer comprising a single layer of solvent-resistant material, the base layer formed from a thermoplastic material; and a reinforcing layer including a single layer of mesh positioned over the base layer, the mesh comprising a plurality of fiberglass strands in a grid arrangement, the grid arrangement defining substantially square openings between adjacent strands, the strands having a nominal thickness that is smaller than the shortest dimension of the substantially square openings, resulting in large voids between the strands adapted to promote uniform application and distribution of an adhesive through the mesh material and onto the base layer.

2. The reinforced core of claim 1, wherein the base layer is formed from a single ply of material.

3. The reinforced core of claim 1 further comprising an adhesive for bonding the reinforcing layer to the base layer.

4. The reinforced core of claim 1, wherein the core consists of the base layer and the reinforcing layer.

5. The reinforced core of claim 1, wherein the reinforcing layer and the base layer are helically wound.

6. The reinforced core of claim 5, wherein the reinforcing layer covers the base layer in a criss-cross overlap.

7. A reinforced paint roller comprising:

a base layer comprising a single layer of solvent-resistant material, the base layer formed from a thermoplastic material;

a reinforcing layer including a single layer of mesh positioned over the base layer, the mesh comprising a plurality of fiberglass strands in a grid arrangement, the grid arrangement defining substantially square openings between adjacent strands, the strands having a nominal thickness that is smaller than the shortest dimension of the substantially square openings, resulting in large voids between the strands adapted to promote uniform application and distribution of an adhesive through the mesh material and onto the base layer; and a fabric cover positioned over the reinforcing layer.

8. The reinforced paint roller of claim 7, wherein the base layer is formed from a single ply of material.

9. The reinforced paint roller of claim 7 further comprising an adhesive for bonding the reinforcing layer to the base layer.

10. The reinforced paint roller of claim 7, wherein the paint roller consists of the base layer, the reinforcing layer, and the fabric cover.

11. The reinforced paint roller of claim 7, wherein the reinforcing layer and the base layer are helically wound.

12. The reinforced paint roller of claim 11, wherein the reinforcing layer covers the base layer in a criss-cross overlap.

13. The reinforced paint roller of claim 7 comprising a layer of adhesive distributed through the strands of the reinforcing layer, the layer of adhesive in contact with both the base layer and the fabric cover to bond the fabric cover to the base layer through the substantially square openings of the reinforcing layer.

14. The reinforced paint roller of claim 7 comprising a single layer of adhesive bonding all components of the paint roller together, the single layer of adhesive distributed through the strands of the reinforcing layer, the single layer of adhesive bonding the reinforcing layer to the base layer, and bonding the fabric cover to the reinforcing layer and base layer.

15. A reinforced paint roller comprising:

a base layer comprising a layer of material having a thickness, the base layer formed from a thermoplastic material;

a reinforcing layer comprising a net positioned over the base layer, the net formed of strands extending in multiple directions;

a layer of adhesive distributed on the base layer between the strands; and a fabric cover positioned over the net, the net defining openings between adjacent strands, the strands of the net having a nominal thickness that is smaller than the shortest dimension of the openings, resulting in large voids that promote uniform application and distribution of the adhesive through the net and onto the base layer between the strands so that substantially all of the fabric cover directly contacts substantially all of the base layer, with substantially all of the adhesive bonding the fabric cover directly to the base layer.

16. The reinforced paint roller of claim 15, wherein the strands are formed of a non-absorbent material that cannot absorb the adhesive.

17. The reinforced paint roller of claim 15, wherein the strands are formed of fiberglass.

18. The reinforced paint roller of claim 15, wherein the base layer consists of a single layer of the material.

19. The reinforced paint roller of claim 15, wherein the reinforcing layer consists of a single layer of the net.

20. The reinforced paint roller of claim 15, wherein the nominal thickness of the strands is substantially smaller than the thickness of the base layer.

* * * * *